US005696440A

United States Patent [19]

Harada

[11] Patent Number: 5,696,440

[45] Date of Patent: Dec. 9, 1997

[54] CONSTANT CURRENT GENERATING APPARATUS CAPABLE OF STABLE OPERATION

[75] Inventor: Hirotaka Harada, Tokyo, Japan

[73] Assignee: NEC Corporation, Tokyo, Japan

[21] Appl. No.: 311,867

[22] Filed: Sep. 26, 1994

[30] Foreign Application Priority Data

Sep. 30, 1993 [JP] Japan ..... 5-243427

[51] Int. Cl.[6] ..... G05F 3/16

[52] U.S. Cl. ..... 323/315; 323/316; 323/313

[58] Field of Search ..... 323/315, 316, 323/311

[56] References Cited

U.S. PATENT DOCUMENTS

| | | | |
|---|---|---|---|
| 3,777,638 | 12/1973 | Yata et al. | 95/10 |
| 4,563,632 | 1/1986 | Palara et al. | 323/316 |
| 4,714,901 | 12/1987 | Jain et al. | 331/176 |
| 5,006,738 | 4/1991 | Usuki et al. | 307/594 |
| 5,180,966 | 1/1993 | Sugawara et al. | 323/308 |
| 5,334,929 | 8/1994 | Schade, Jr. | 323/315 |

FOREIGN PATENT DOCUMENTS 4-35523 2/1992 Japan .

*Primary Examiner*—Peter S. Wong
*Assistant Examiner*—Rajnikant B. Patel
*Attorney, Agent, or Firm*—Sughrue,Mion,Zinn,Macpeak & Seas, PLLC

[57] ABSTRACT

In a constant current generating apparatus including a constant current circuit for generating a constant current at an output terminal and an activation circuit for activating the constant current circuit, a control circuit is provided to turn ON the activation circuit in accordance with the potential at the output terminal.

9 Claims, 3 Drawing Sheets

CONSTANT CURRENT GENERATING APPARATUS CAPABLE OF STABLE OPERATION

BACKGROUND OF THE INVENTION

1. Field of the Invitation

The present invention relates to a constant current generating apparatus capable of stable operation.

2. Description of the Related Art

Generally, a constant current generating apparatus is incorporated into a semiconductor integrated circuit. A prior art constant current generating apparatus includes a constant current circuit for generating a constant current at an output terminal and an activation circuit for activating the constant current circuit. In this case, the activation circuit is driven by a power-on reset circuit which generates a signal pulse signal when a power supply voltage is increased from 0 V to a definite voltage. This will be explained later in detail.

In the above-described prior art constant current generating apparatus, however, since the power-on reset circuit generates only a single pulse signal in a power-on mode, if the activation of the current circuit by the activation circuit using the single pulse signal fails, the current constant circuit will never be activated unless the power is again turned ON.

SUMMARY OF THE INVENTION

It is an object of the invention to provide a constant current generating apparatus capable of stable operation even after power is completely turned ON.

According to the present invention, in a constant current generating apparatus including a constant current circuit for generating a constant current at an output terminal and an activation circuit for activating the constant current circuit, a control circuit is provided to turn ON the activation circuit in accordance with the potential at the output terminal. Thus, even after power is completely turned ON, if the activation of the constant current circuit fails, the activation of the constant current circuit is repeated until the constant current circuit is activated.

BRIEF DESCRIPTION OF THE DRAWINGS

The present invention will be more clearly understood from the description as set forth below, in comparison with the prior art, with reference to the accompanying drawings, wherein.

DESCRIPTION OF THE PREFERRED EMBODIMENTS

Before the description of the preferred embodiments, a prior art constant current generating apparatus will be explained with reference to FIG. 1.

Figure 1:
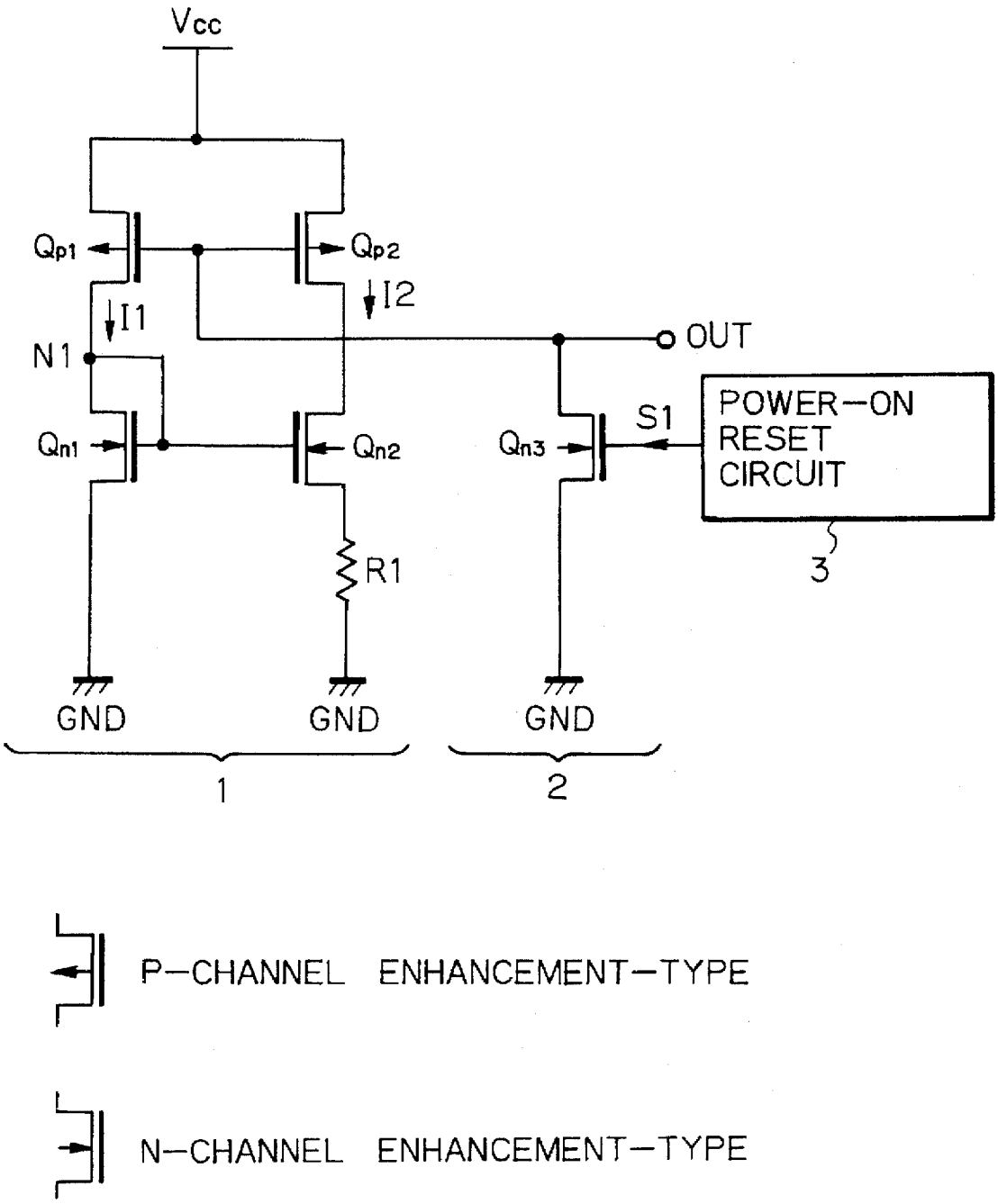
Fig. 1 PRIOR ART
FIG. 1 is a circuit diagram illustrating a prior art constant current generating apparatus.

In FIG. 1, reference numeral 1 designates a constant current circuit formed by P-channel enhancement-type MOS (broadly, MIS) transistors $Q_{p1}$ and $Q_{p2}$, N-channel enhancement-type MOS transistors $Q_{n1}$ and $Q_{n2}$, and a resistor R1.

Sources of the transistors $Q_{p1}$ and $Q_{p2}$ are connected to a power supply terminal depicted by $V_{cc}$, and gates of the transistors $Q_{p1}$, and $Q_{p2}$ are connected to an output terminal OUT. Therefore, the transistors $Q_{p1}$ and $Q_{p2}$ form a current mirror circuit having an input current I2 and an output current I1. In this current mirror circuit, a current supplying ability of the transistor $Q_{p1}$ is the same as that of the transistor $Q_{p2}$.

On the other hand, sources of the transistors $Q_{n1}$ and $Q_{n2}$ are connected to a power supply terminal depicted by GND, and gates of the transistors $Q_{n1}$ and $Q_{n2}$ are connected to a node N1. Therefore, the transistors $Q_{n1}$ and $Q_{n2}$ with the resistor R1 form a current mirror circuit having an input current I1 and an output current I2. In this current mirror circuit, a current supplying ability of the transistor $Q_{n2}$ is larger than that of the transistor $Q_{n1}$.

Reference numeral 2 designates an activation circuit for activating the constant current circuit 1. The activation circuit 2 is formed by an N-channel enhancement-type transistor $Q_{n3}$ which is controlled by a power-on reset circuit 3. The power-on reset circuit 3 generates a single pulse signal S1 when the power is turned ON to increase the potential $V_{cc}$.

The operation of the constant current generating apparatus of FIG. 1 will now be explained.

Due to the current mirror circuit formed by the transistors $Q_{p1}$ and $Q_{p2}$ having the same current supplying ability, the current I1 is equal to the current I2. The constant current circuit 1 has two states: a non-current state and a constant current state.

First, in a non-current state where I1=I2=0, when the power is turned ON so that the potential $V_{cc}$ is increased, the potential at the output terminal OUT follows the potential $V_{cc}$ under the condition:

$$V_{OUT}=V_{cc}-|V_{pth}|$$

Where $V_{OUT}$ is the potential at the output terminal OUT; and $V_{pth}$ is the threshold voltage of P-channel enhancement-type transistors, such as $Q_{p1}$. Even in this state, I1=I2=0.

Next, when the power-on reset circuit 3 generates a single pulse signal S1, the transistor $Q_{n3}$ is turned ON. As a result, the potential at the output terminal OUT, i.e., the potential at the gates of the transistors $Q_{p1}$ and $Q_{p2}$ is made 0 V, and therefore, the transistors $Q_{p1}$ and $Q_{p2}$ turn ON so that the currents I1 and I2 flow through the transistors $Q_{p1}$ and $Q_{p2}$, respectively. Therefore, the potential at the node N1, i.e., the potential at the gates of the transistors $Q_{n1}$ and $Q_{n2}$ is increased to turn ON the transistors $Q_{n1}$ and $Q_{n2}$. In this state, I1=I2.

Finally, when the signal pulse signal S1 of the power-on reset circuit 3 returns to 0 V, the transistor $Q_{n3}$ is turned OFF. As a result, the current I2 is switched from a path through the transistor $Q_{n3}$ to a path through the transistor $Q_{n2}$ and the resistor R1. In this case, if a ratio of the current supplying ability of the transistor $Q_{n2}$ to that of the transistor $Q_{n1}$ is n (n>1), the current I2 is increased to n·I1. Simultaneously, the current I1 is increased to I2 due to the current mirror circuit formed by the transistors $Q_{p1}$ and $Q_{p2}$. In this case, however, since the potential at the source of the transistor $Q_{n2}$ is increased by the reduction in potential of the resistor R1, the current supplying ability of the transistor $Q_{n2}$ is decreased, so that the contant current circuit 1 enters an equilibium state. i.e., a constant current state. In this case, I1=I2=α, where α is a definite value which is not dependent upon the potential $V_{cc}$.

In the constant current generating circuit of FIG. 1, however, if the single pulse signal S1 of the power-on reset circuit 3 fails to turn ON the transistors $Q_{n1}$ and $Q_{n2}$, the transistors $Q_{p1}$ and $Q_{p2}$ return to an OFF state, i.e., the constant current circuit 1 returns to a non-current state. Thus, the constant current circuit 1 is no longer in a constant current state.

Figure 2:
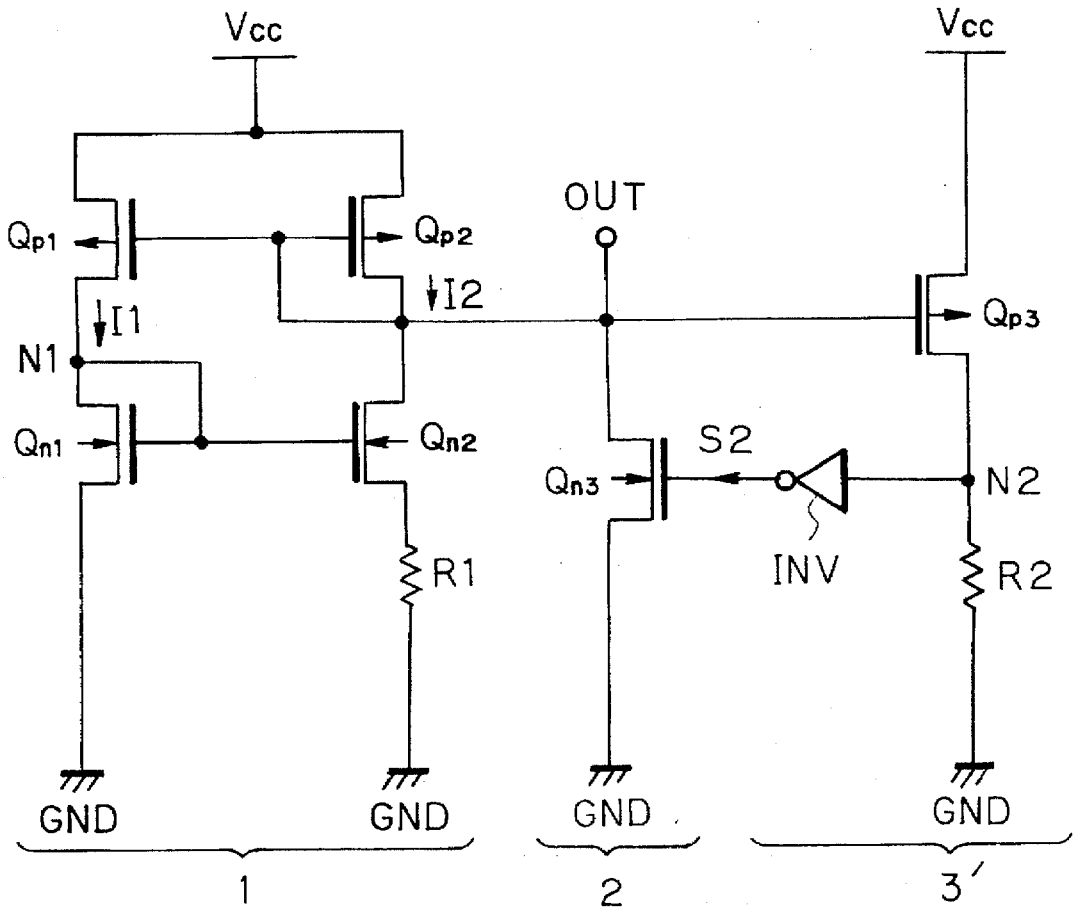
FIG. 2 is a circuit diagram illustrating a first embodiment of the constant current generating apparatus according to the present invention.
Figure 2:
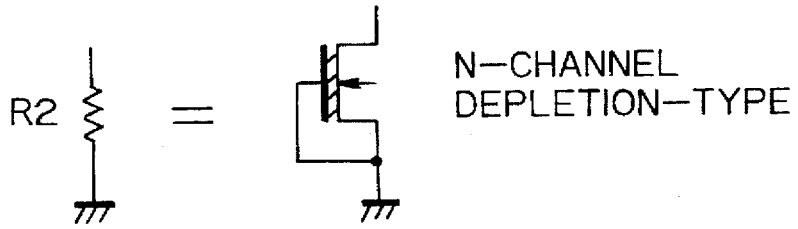

In FIG. 2, which illustrates a first embodiment of the present invention, a control circuit 3' is provided instead of the power-on reset circuit 3 of FIG. 1. The control circuit 3' includes a P-channel enhancement-type MOS transistor $Q_{p3}$, a resistor R2, and an inverter INV. In the control circuit 3', when $V_{cc}-V_{OUT}>|V_{pth}|$, the transistor $Q_{p3}$ is turned ON, so that the potential at a node N2 is high. Thus, the output S2 of the inverter INV is made low so as to turn OFF the transistor $Q_{n3}$. Conversely, when $V_{cc}-V_{OUT}\leq|V_{pth}|$, the transistor $Q_{p3}$ is turned OFF, so that the potential at the node N2 is low. Thus, the output S2 of the inverter INV is made high so as to turn ON the transistor $Q_{n3}$.

The operation of the constant current generating circuit of FIG. 2 will now be explained.

First, in a non-current state before the power is turned OFF, I1=I2=0 and $V_{cc}=V_{OUT}=0$.

Immediately after the power is turned ON, the difference between $V_{cc}$ and $V_{OUT}$ is smaller than $|V_{pth}|$, and therefore, the transistor $Q_{p3}$ is turned OFF. As a result, the potential at the node N2 is made low, and therefore, the output S2 of the inverter INV is high, to thereby turn ON the transistor $Q_{n3}$. Thus, the potential $V_{OUT}$ at the output terminal OUT is 0 V, to excite currents I1 and I2 flowing through the transistors $Q_{p1}$ and $Q_{p2}$, respectively. Simultaneously, since the potential $V_{OUT}$ at the output terminal OUT is 0 V to turn ON the transistor $Q_{p3}$, a current flows through the resistor R2. As a result, when the potential at the node N2 exceeds a threshold voltage of the inverter INV, the output S2 of the inverter INV is changed from high to low (0 V), to thereby put the constant current circuit 1 in a constant current state.

Even at this time, if the constant current circuit 1 fails to enter a constant current state, the potential $V_{OUT}$ at the output terminal OUT is increased to turn OFF the transistor $Q_{p3}$. Thus, the above-described current exciting operation is repeated until the constant current circuit 1 enters in a constant current state.

In FIG. 2, the value of the resistor R2 is relatively large. Therefore, in order to reduce an area therefor, the resistor R2 can be constructed by a source-gate connected N-channel depletion-type MOS transistor.

Figure 3:
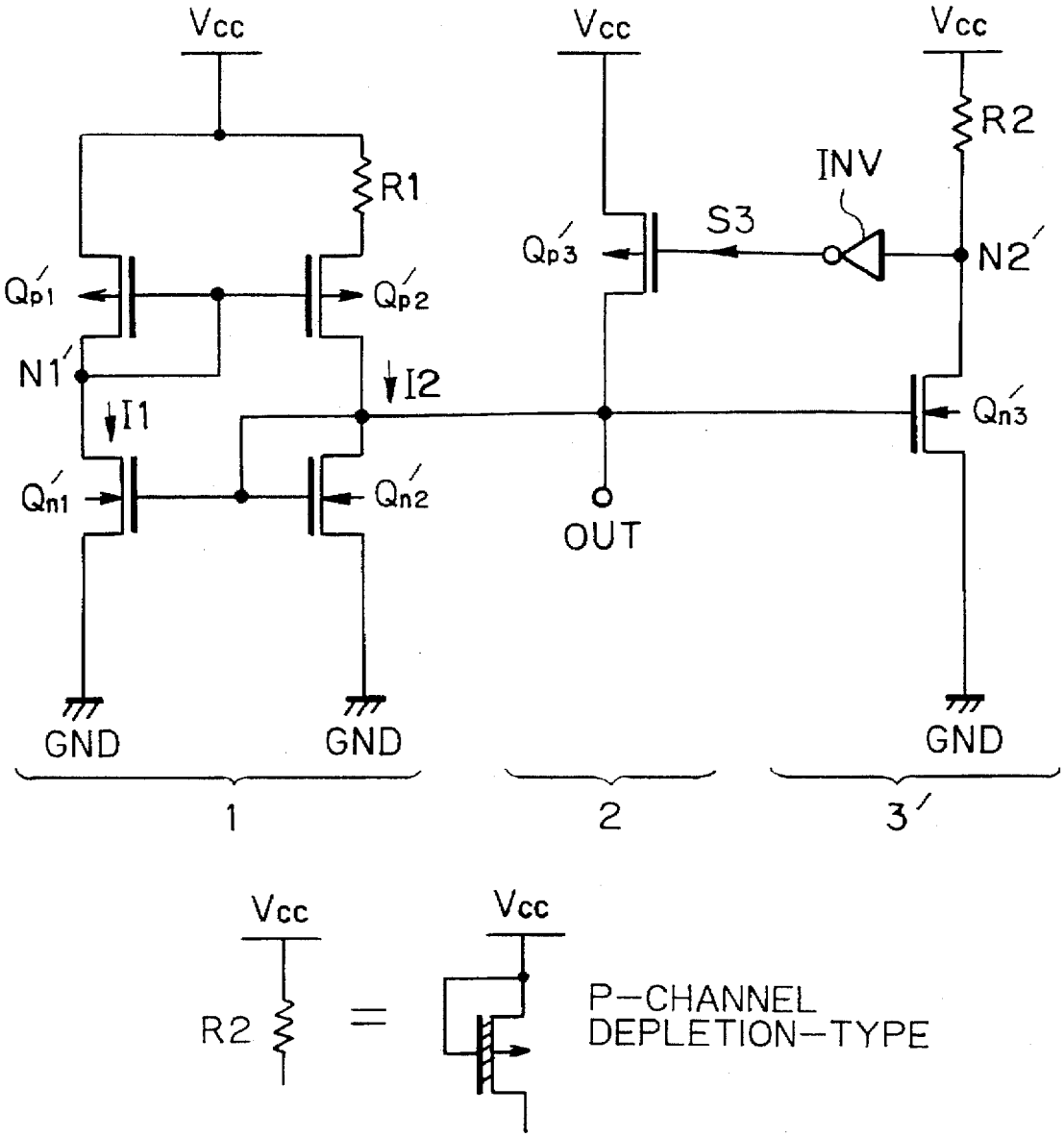
FIG. 3 is a circuit diagram illustrating a second embodiment of the constant current generating apparatus according to the present invention.

In FIG. 3, which illustrates a second embodiment of the present invention, the P-channel transistors $Q_{p1}$, $Q_{p2}$ and $Q_{p3}$ of FIG. 2 are replaced by N-channel MOS transistors $Q_{n1}'$, $Q_{n2}'$ and $Q_{n3}'$, respectively, and the N-channel transistors $Q_{n1}$, $Q_{n2}$ and $Q_{n3}$ of FIG. 2 are replaced by P-channel MOS transistors $Q_{pl}'$, $Q_{p2}'$ and $Q_{p3}'$, respectively. Also, the power supply terminal depicted by $V_{cc}$ and GND are reversed.

The operation of the constant current generating apparatus of FIG. 3 is similar to that of the constant current generating apparatus of FIG. 2.

That is, first, in a non-current state before the power is turned ON, I1=I2=0 and $V_{cc}=V_{OUT}=0$.

Immediately after the power is turned ON, the difference between $V_{cc}$ and $V_{OUT}$ is smaller than $V_{nth}$, where $V_{nth}$ is a threshold voltage of the N-channel transistors, and therefore, the transistor $Q_{n3}'$ is turned OFF. As a result, the potential at the node N2' is made high, and therefore, the output S3 of the inverter INV is low, to thereby turn ON the transistor $Q_{p3}'$. Thus, the potential $V_{OUT}$ at the output terminal OUT is $V_{cc}$, to excite currents I1 and I2 flowing through the transistors $Q_{n1}'$ and $Q_{n2}'$, respectively. Simultaneously, since the potential $V_{OUT}$ at the output terminal OUT is $V_{cc}$ to turn ON the transistor $Q_{p3}'$, a current flows through the resistor R2. As a result, when the potential at the node N2' becomes lower than a threshold voltage of the inverter INV, the output S3 of the inverter INV is changed from low to high ($V_{cc}$), to thereby put the constant current circuit 1 in a constant current state.

Even at this time, if the constant current circuit 1 fails to enter a constant current state, the potential $V_{OUT}$ at the output terminal OUT is decreased to turn OFF the transistor $Q_{n3}'$. Thus, the above-described current exciting operation is repeated until the constant current circuit 1 enters a constant current state.

Also, in FIG. 3, the value of the resistor R2 is relatively large. Therefore, in order to reduce an area therefor, the resistor R2 can be constructed by a source-gate connected P-channel depletion-type MOS transistor.

As explained hereinbefore, according to the present invention, since the exciting operation is repeated until a constant current circuit enters in a constant current state, the constant current generating apparatus of the present invention can be stably operated.

I claim:

1. A constant current generating apparatus comprising:

a constant current circuit for generating a constant current at an output terminal;

an activation circuit, connected to said output terminal, for forcibly making a potential at said output terminal a definite value, and for activating said constant current circuit; and a control circuit, connected to said output terminal and said activation circuit, for controlling said activation circuit in accordance with the potential at said output terminal.

2. An apparatus as set forth in claim 1, further comprising first and second power supply terminals, said constant current circuit comprising:

a first current mirror circuit, connected to said first power supply terminal, said first current mirror circuit including two first enhancement-type MIS transistors of a first conductivity, each of said first enhancement-type MIS transistors having the same current supplying ability; and a second current mirror circuit, connected between said first current mirror circuit and said second power supply terminal, said second current mirror circuit including two second enhancement-type MIS transistors of a second conductivity type opposite to the first conductivity type, one of said second MIS enhancement-type transistors having a larger current supplying ability than the other, said second current mirror circuit further including a first resistor connected between one of said second enhancement-type MIS transistors and said second power supply terminal, an output node of said first current mirror circuit being connected to an input node of said second current mirror circuit, an output node of said second current mirror circuit being connected to an input node of said first current mirror circuit and to said output terminal.

3. An apparatus as set forth in claim 2, wherein said activation circuit forcibly turns ON said first current mirror circuit.

4. An apparatus as set forth in claim 2, wherein said control circuit comprises:

means for determining whether or not a difference between the potential at said first power supply terminal and the potential at said output terminal is smaller than a definite value; and means for turning ON said activation circuit when the difference between the potential at said first power supply terminal and the potential at said output terminal is smaller than the definite value.

5. An apparatus as set forth in claim 4, wherein said activation circuit comprises a third enhancement-type MIS transistor of the second conductivity type connected between said output terminal and said second power supply terminal.

6. An apparatus as set forth in claim 4, wherein said control circuit comprises:

a fourth enhancement-type MIS transistor of the first conductivity type, connected to said first power supply terminal, said fourth enhancement-type MIS transistor having a gate controlled by the potential at said output terminal;

a second resistor, connected between said fourth enhancement-type MIS transistor and said second power supply terminal;

an inverter connected to a node between said fourth enhancement-type MIS transistor and said second resistor, an output of said inverter being connected to said activation circuit.

7. An apparatus as set forth in claim 5, wherein said second resistor comprises a depletion type MIS transistor of the second conductivity type having a source connected to a gate thereof and to said second power supply terminal, and having a drain connected to said third MIS transistor.

8. A constant current apparatus for supplying a constant current to an output terminal, comprising:

a first power supply terminal for receiving a first potential;

a second power supply terminal for receiving a second potential lower than the first power potential;

a first MIS transistor of a P-channel type connected between said first power supply terminal and a first node, said first MIS transistor having a gate connected to said output terminal;

a second MIS transistor of a P-channel type connected between said first power supply terminal and said output terminal, said second MIS transistor having a gate connected to said output terminal, said second MIS transistor having the same current supplying ability as said first MIS transistor;

a third MIS transistor of an N-channel type connected between said first node and said second power supply terminal, said third MIS transistor having a gate connected to said first node;

a first resistor connected to said second power supply terminal;

a fourth MIS transistor of the N-channel type connected between said output terminal and said first resistor, said fourth MIS transistor having a gate connected to said first node, said fourth MIS transistor having a larger current supplying ability than said third MIS transistor;

a fifth MIS transistor of the N-channel type connected between said output terminal and said second power supply terminal;

a sixth MIS transistor of the P-channel type connected between said first power supply terminal and a second node, said sixth MIS transistor having a gate controlled by a potential at said output terminal;

a second resistor connected between said second node and said second power supply terminal; and an inverter connected between said second node and a gate of said fifth MIS transistor.

9. A constant current apparatus for supplying a constant current to an output terminal, comprising:

a first power supply terminal for receiving a first potential;

a second power supply terminal for receiving a second potential higher than the first potential;

a first MIS transistor of an N-channel type connected between said first power supply terminal and a first node, said first MIS transistor having a gate connected to said output terminal a second MIS transistor of the N-channel type connected between said first power supply terminal and said output terminal, said second MIS transistor having a gate connected to said output terminal, said second MIS transistor having the same current supplying ability as said first MIS transistor;

a third MIS transistor of a P-channel type connected between said first node and said second power supply terminal, said third MIS transistor having a gate connected to said first node;

a first resistor connected to said second power supply terminal;

a fourth MIS transistor of the P-channel type connected between said output terminal and said first resistor, said fourth MIS transistor having a gate connected to said first node, said fourth MIS transistor having a larger current supplying ability than said third MIS transistor;

a fifth MIS transistor of the P-channel type connected between said output terminal and said second power supply terminal;

a sixth MIS transistor of the N-channel type connected between said first power supply terminal and a second node, said sixth MIS transistor having a gate controlled by the potential at said output terminal;

a second resistor connected between said second node and said second power supply terminal; and an inverter connected between said second node and a gate of said fifth MIS transistor.

* * * * *